US006534698B2

(12) United States Patent
Hoshino

(10) Patent No.: US 6,534,698 B2
(45) Date of Patent: Mar. 18, 2003

(54) SNARE STRAINER FOR A SNARE DRUM

(75) Inventor: Yoshihiro Hoshino, Nagoya (JP)

(73) Assignee: Hoshino Gakki Kabushiki Kaisha (JP)

( * ) Notice: Subject to any disclaimer, the term of this patent is extended or adjusted under 35 U.S.C. 154(b) by 0 days.

(21) Appl. No.: 09/976,743

(22) Filed: Oct. 12, 2001

(65) Prior Publication Data

US 2002/0083817 A1 Jul. 4, 2002

(30) Foreign Application Priority Data

Dec. 28, 2000 (JP) ..... 2000-402608

(51) Int. Cl.[7] ..... G10D 13/02
(52) U.S. Cl. ..... 84/415; 821/411 R
(58) Field of Search ..... 84/415, 411 R

(56) References Cited

U.S. PATENT DOCUMENTS 5,559,296 A * 9/1996 Yamashita ..... 84/415
5,616,875 A * 4/1997 Lombardi ..... 84/415
5,844,157 A * 12/1998 Kasha ..... 84/415

* cited by examiner

*Primary Examiner*—Shih-Yung Hsieh
(74) *Attorney, Agent, or Firm*—Ostrolenk, Faber, Gerb & Soffen

(57) ABSTRACT

To adjust the tension on the snare of a drum head, one end of the snare is supported to an adjustment device, including a base on the drum trunk, a slide guided for movement vertically along the base and the snare is attached to the movable slide. First and second switches are pivotable on the base between off and on positions. Two shafts are attached to the slide. A respective link leads from each switch to a lifting member on the shaft and moving up of the switch moves the lifting member to raise the shaft to raise the slide to a varying extent depending upon the height of an adjustment nut on each of the shaft. The nuts on the two share adjustable for setting high tension and low tension on the snare.

11 Claims, 15 Drawing Sheets

SNARE STRAINER FOR A SNARE DRUM

BACKGROUND OF THE INVENTION

The present invention relates to a snare strainer for a snare drum and to a device for adjusting and switching the tension of the snare in multiple stages.

In a conventional snare drum, a snare (also called a snare snappy) is provided on a snare strainer. As the strainer is set on or off, the snare is respectively caused to touch or become separated from the drum head surface on the bottom. The tone color of the snare when it is on the drum head is adjusted by an adjusting member, such as a knob for adjusting the tension of the snare. The sound becomes short and dry at the time when the tension of the snare is high or strong and it becomes low and prolonged at the time when the tension is low or weak.

In a conventional apparatus, the tension of the snare is adjusted beforehand, with only the switching of the snare on or off being carried out during a performance. Due to such a circumstance, there has been an increasing demand from performers to be able to quickly switch the tone color of the snare even during their performances.

The device disclosed in U.S. Pat. No. 5,684,257 was proposed to meet that demand. According to this technology, a plurality of arc-shaped engagement positions are determined in advance for the purpose of later switching the tension of the snare. During a performance, the switch lever is operated, thereby changing the engagement position of that lever and changing the tension of the snare, creating a different tone color.

Using this prior art technology, however, the engagement position of the switch lever for switching the tension of the snare is determined in advance. This may make it impossible for a performer to obtain the tone color he desires even though a plurality of different tone colors can be obtained.

SUMMARY OF THE INVENTION

An object of this invention is to solve the problem of the prior art described above. The invention provides a snare strainer for a snare drum which has a plurality of adjustment positions and is capable of adjustment without steps in conformity with the wishes of the performer and enables the performer to make quick switches.

The invention relates to a device for adjusting and switching the tension of the snare extending across the drum head face on the bottom side which is stretched on the drum trunk in multi-stages. The device comprises a base attached to the drum trunk, a vertical axle for a slide and a horizontal axle for snare tension adjusting switches on the base. A slide is installed freely movably in the up and down directions on the vertical axle. An intensification member applies downward force on the slide along the vertical axle.

A plurality of position adjustment members are fixed to the slide. An adjustment nut is screwed onto a thread at the top of each adjustment member so that each adjustment nut may be adjusted between top and bottom positions. Lifting members lift each position adjustment member in engagement with the respective adjustment nut. Links have one end joined with each lifting member. The other end of each link is joined by an axle with a switch lever.

At least two switch levers pivot on the horizontal axle on the base. When the at least two switch levers are switched on, their corresponding position adjustment members are lifted by the corresponding lifting members by means of the corresponding links. This elevates the slide to a respective height position set by the performer so as to tighten the snare to a selected extent. Switching off each switch lever removes the lifting of the corresponding position adjustment member of the corresponding lifting member due to movement of the corresponding link. This makes it possible for the slide to be lowered to a respective original height position under the influence of the intensifying member.

In the snare strainer for the snare drum, the plurality of position adjustment members, lifting members, links and switch levers are respectively for providing high tension positions and low tension positions of the snare.

The switch lever has an engagement part which also switches off the switch lever for high tension positions at the time of switch-off of the switch lever for low tension positions.

A straight moving guide causes the slide to proceed straight between the base and the slide.

Other features and advantages of the present invention will become apparent from the following description of the invention which refers to the accompanying drawings.

DESCRIPTION OF A PREFERRED EMBODIMENT OF THE INVENTION

Figure 1:
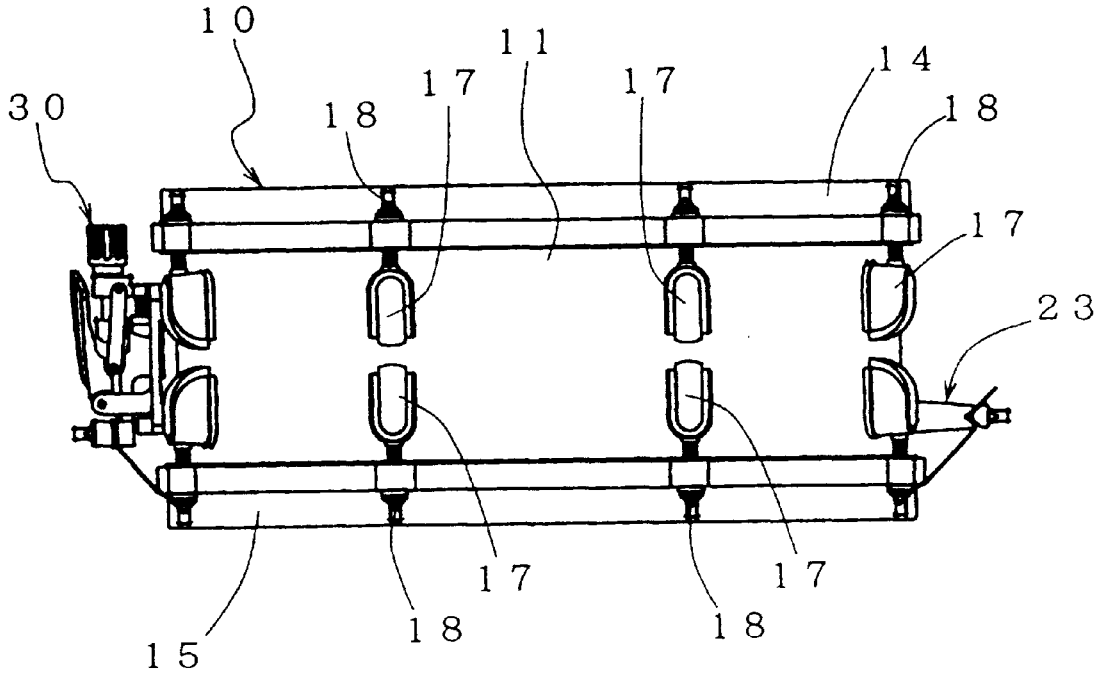
FIG. 1 is a side view of a snare drum which is equipped with a snare strainer according to this invention.
Figure 2:
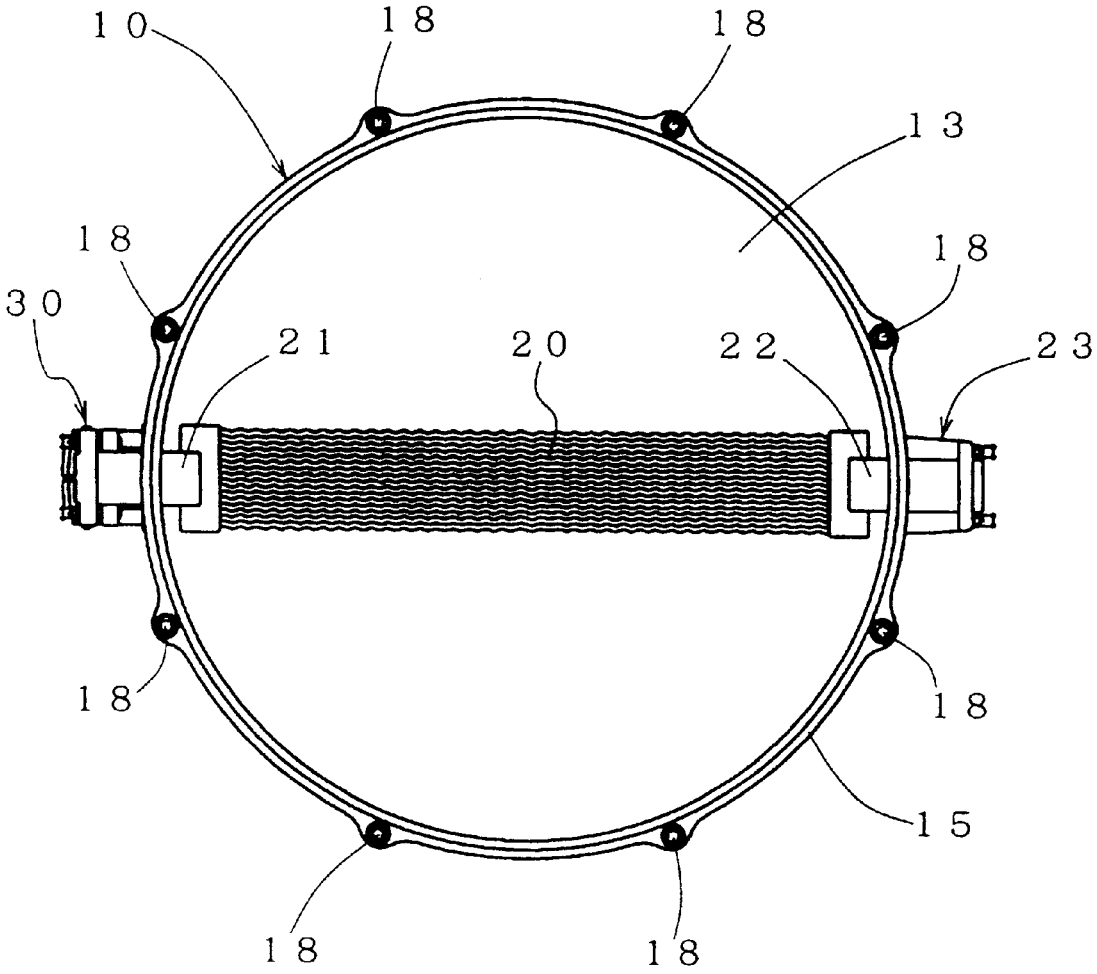
FIG. 2 is a view of the bottom of the snare drum shown in FIG. 1.
Figure 3:
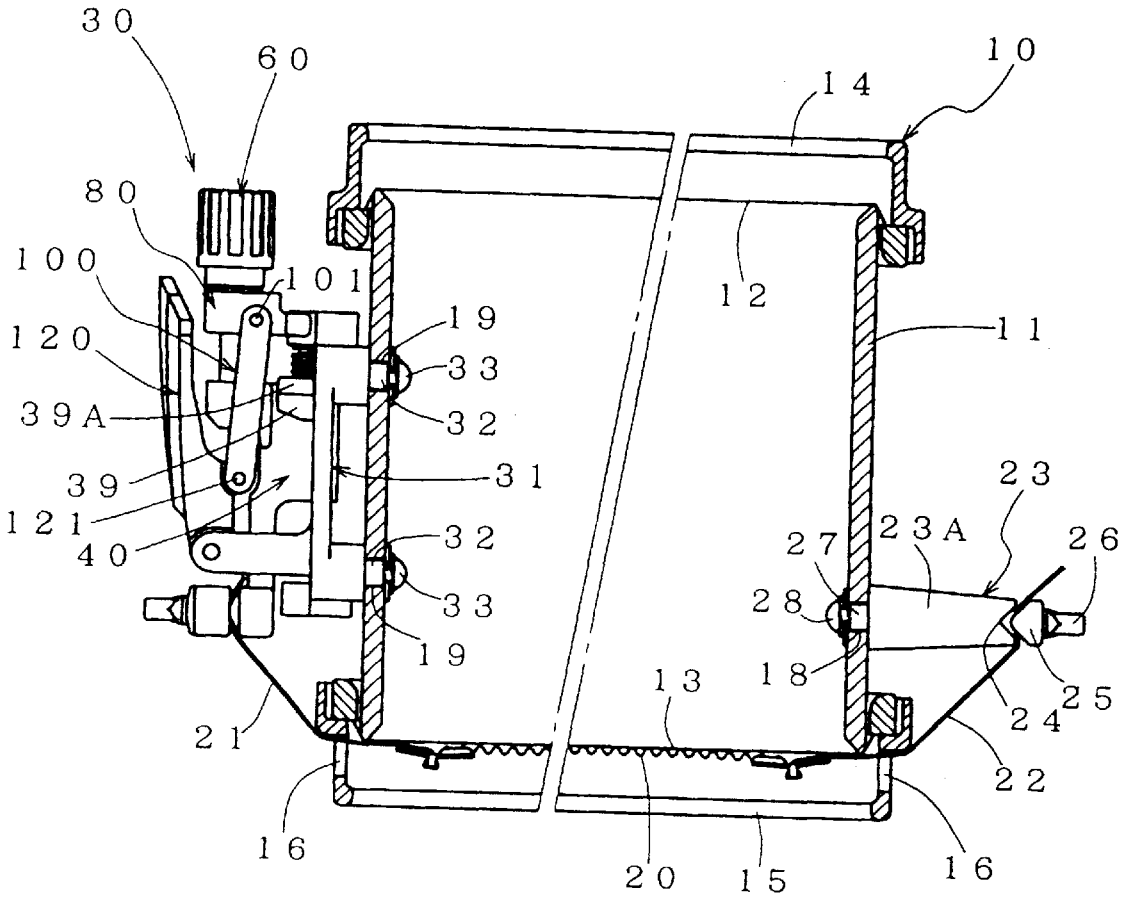
FIG. 3 is a right-side view of a snare strainer where a part of the snare drum shown in FIG. 1 is indicated by a cross section.

As shown in FIGS. 1 through 3, the invention relates to a snare strainer for a snare drum 10 and particularly relates to a device for adjusting and switching the tension of the snare 20 on the lower surface of the drum.

A snare drum 10 has a known construction, which includes a drum trunk 11, an upper drum head 12 which is the beating surface, a bottom side drum head 13 which is a resonant surface, an upper drum hoop 14, and a bottom side drum hoop 15 for enabling insertion of the end belts 21 and 22 of a snare 20. There are lugs 17 for installing the drum heads 12 and 13 on the drum trunk 11. There are a plurality of lug bolts 18 inserted in the lugs at intervals around the drum which secure the drum hoop.

As shown in FIGS. 2 and 3, the snare or snappy is arranged on the surface of the bottom-side drum head 13 of the snare drum 10. One end of the snare is held to the fixed side strainer 23 by the end belt 22, and the other end of the snare is held by the mobile side or operating side strainer 30 through the respective end belt 21.

As shown in FIG. 3, the fixed side strainer 23 sandwiches the end belt 22 of the snare 20 between the holder 24 of the main strainer body 23A and the fixing member 25, and fixes them with a fixing bolt 26. The installation part 27 for the main strainer body 23A is installed in an installation hole 18 in the drum trunk 11. An installation screw 28 is screwed into the inner screw part (not shown) of the installation part 27.

The movable side strainer 30 has a switch mechanism according to the invention which is operable to move the snare 20 on or off the bottom side drum head 13. The invention enables the tension of the snare 20 to be adjusted and switched among a plurality of positions.

The moveable side snare strainer 30 is a mobile side strainer and comprises a base 31, a slide 40, a plurality of position adjusting members 50 and 60, and a respective plurality of lifting members 70 and 80, links 90 and 100 and switch levers 110 and 120.

In the following example, the snare 20 has two tension adjustment positions, high and low, at both of which the snare 20 is in the ON state touching the bottom side drum head 13. However, the invention may include three or more tension adjusting positions.

Figure 4:
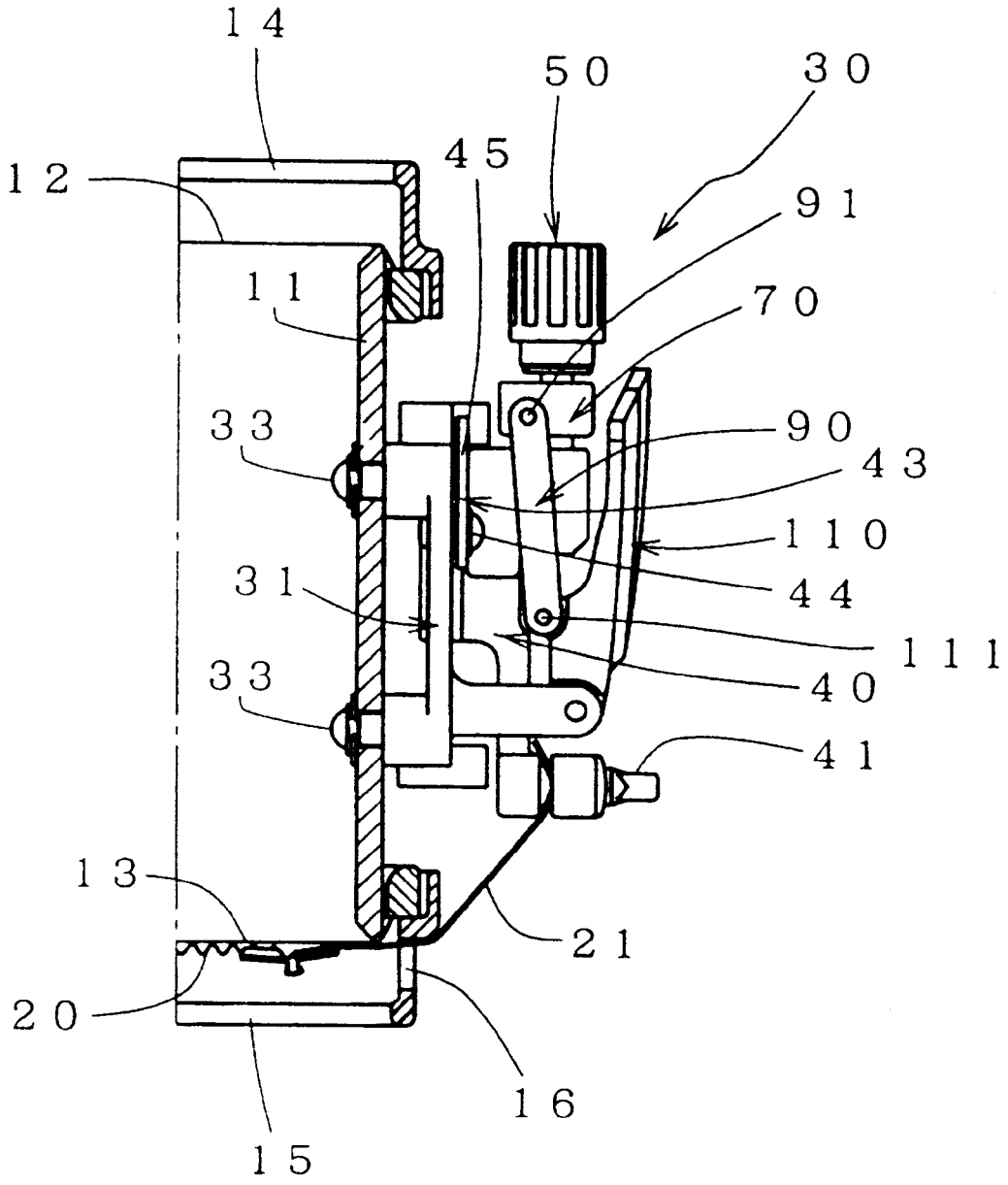
FIG. 4 is a left-side view of the snare strainer.
Figure 10:
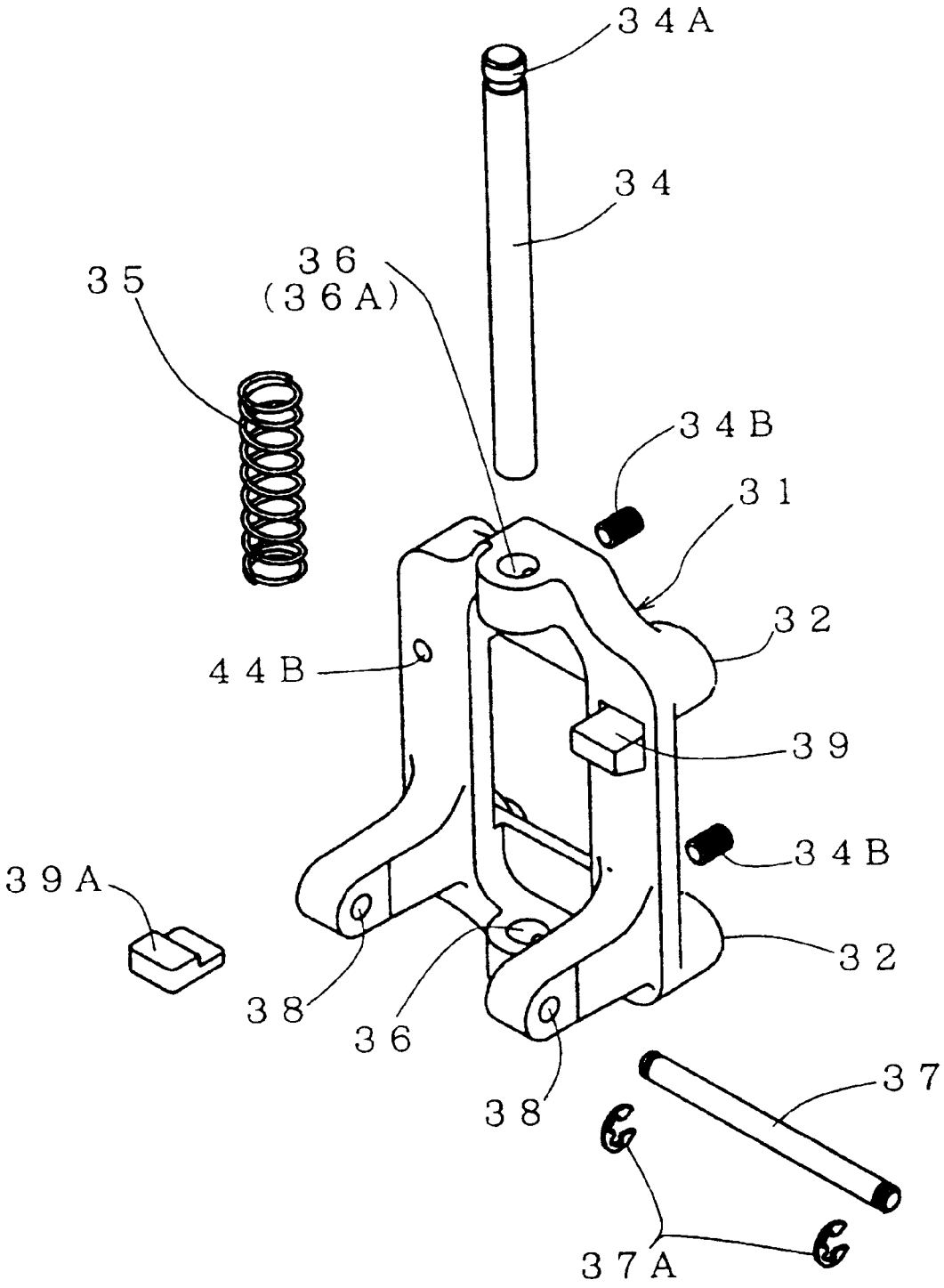
FIG. 10 is an oblique exploded view of the base member.

As shown in FIGS. 3, 4 and 10, the base 31 fixes the snare strainer 30 to the snare drum 10. The base has an installation part 32 which is inserted into an installation hole 19 in the drum trunk 11. An installation screw 33 is to be screwed into an inner screw (not shown) of the installation part 32.

As shown in FIG. 10, the base 31 has a vertical axle 34 for guiding movement of the slide 40, described below, and has a horizontal axle 37 for supporting pivoting of the levers 110 and 120, also described below.

There is an insertion and fixing part 34A at the top of the vertically, axle 34 and also a fixing screw 34B for the vertical axle 34. A coil spring 35, which acts as an intensifying member, is wound around the vertical axle 34. An axle installation hole 36 in the slide receives the vertical axle 34. Another axle installation hole 38 in the slide receives the horizontal axle 37. The axle 37 is held against axial shifting by retaining ring 37A.

A stopper 39 regulates the downward limit position of the slide 40. The stopper has a buffer 39A.

Figure 7:
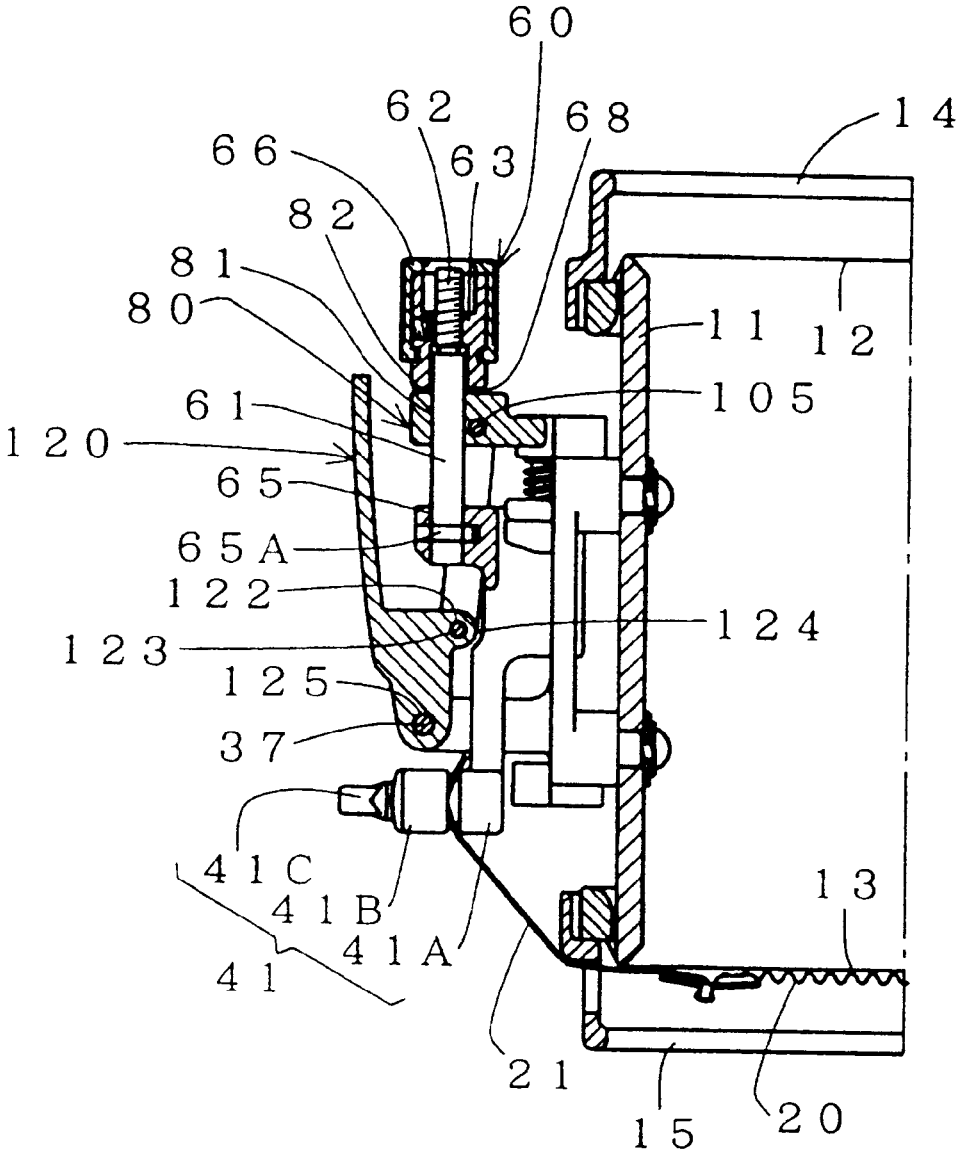
FIG. 7 is a cross section along line 7—7 in FIG. 6.
Figure 9:
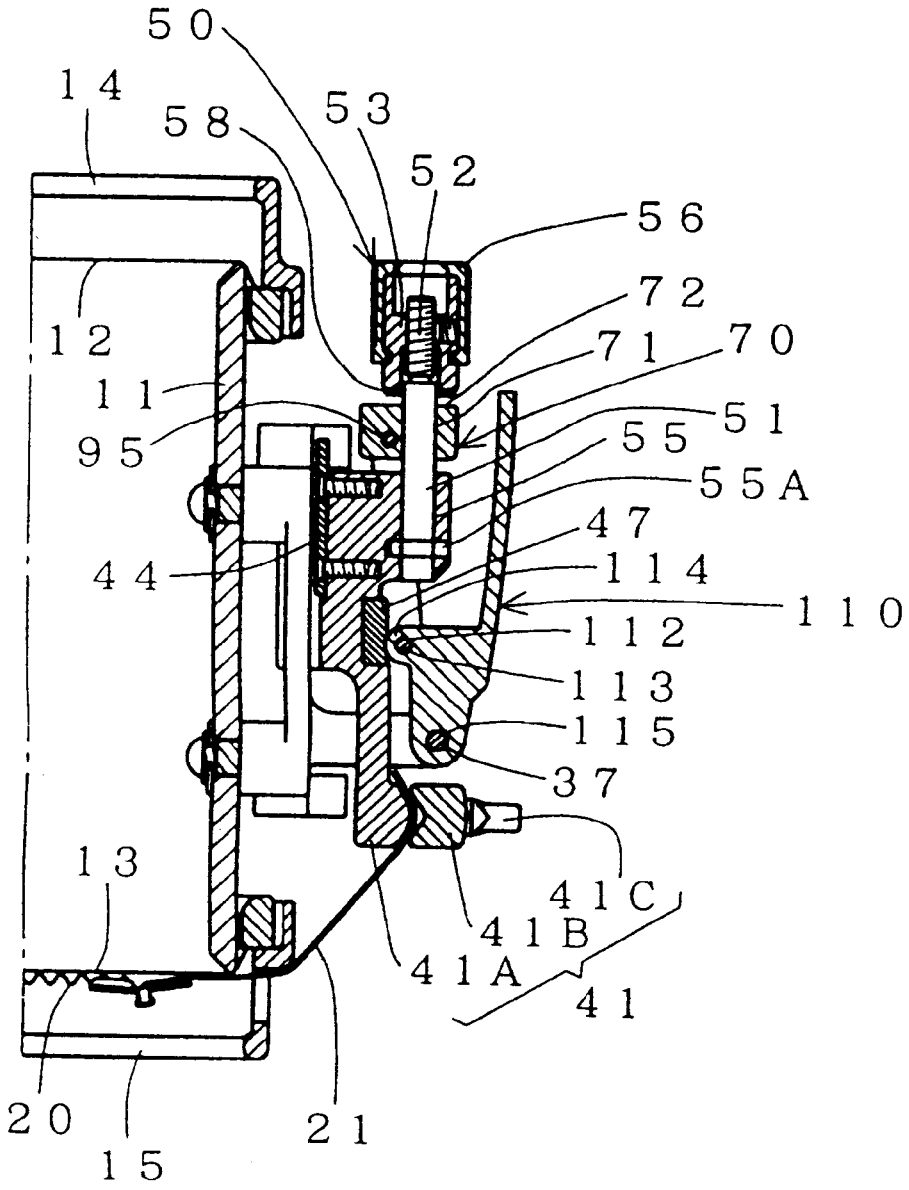
FIG. 9 is a cross section along line 9—9 in FIG. 6.
Figure 11:
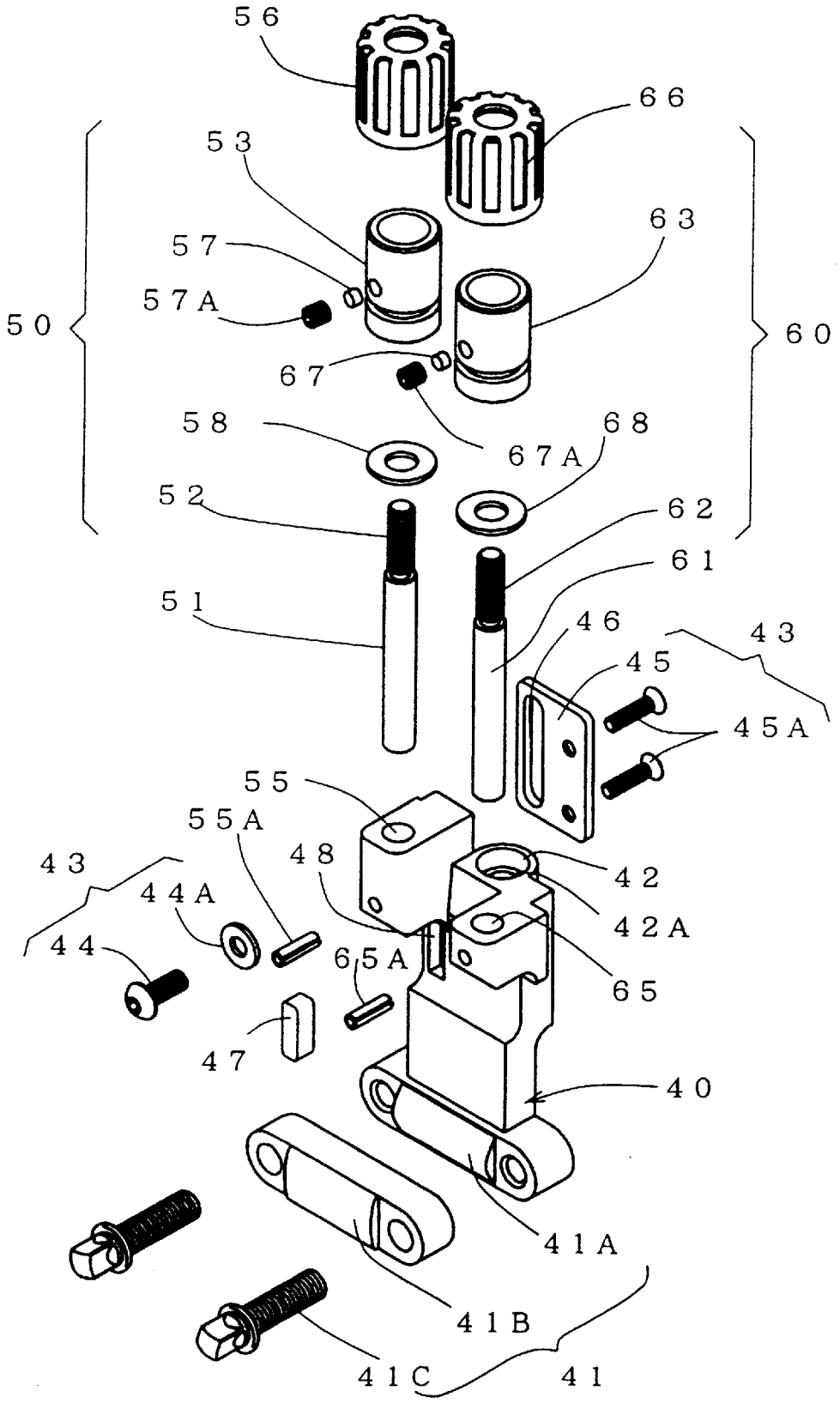
FIG. 11 is an oblique exploded view of the slide member and the position adjustment member.

The slide 40 in FIGS. 3, 4, 7 and 11, includes an installation part 41 at its bottom for holding the end belt 21 at the end of the snare 20, as seen in the cross sections in FIGS. 7 and 9 and in the oblique view in FIG. 11. The slide 40 pulls on the snare 20. The end belt 21 is sandwiched between the holding part 41A for the slide 40 and the fixing member 41B. The installation part 41 is fixed by fixing bolts 41C.

Figure 6:
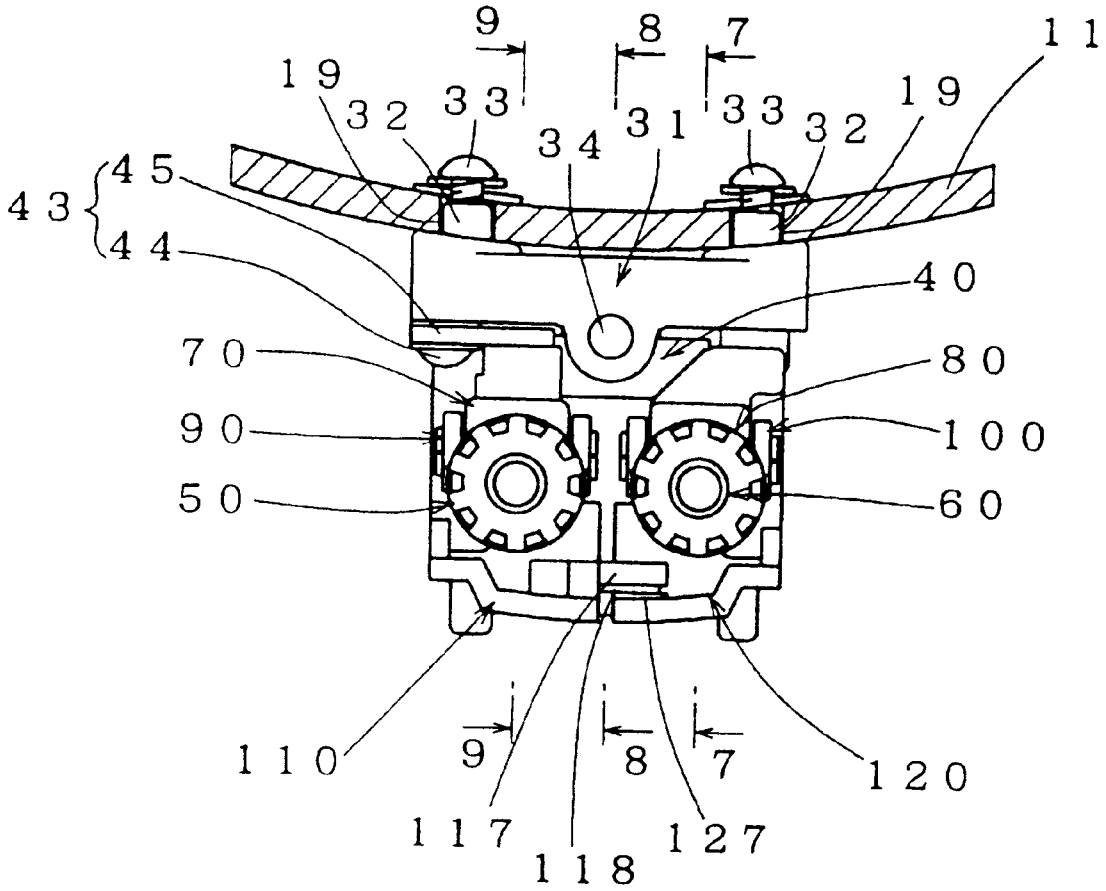
FIG. 6 is a plan view of the snare strainer.
Figure 8:
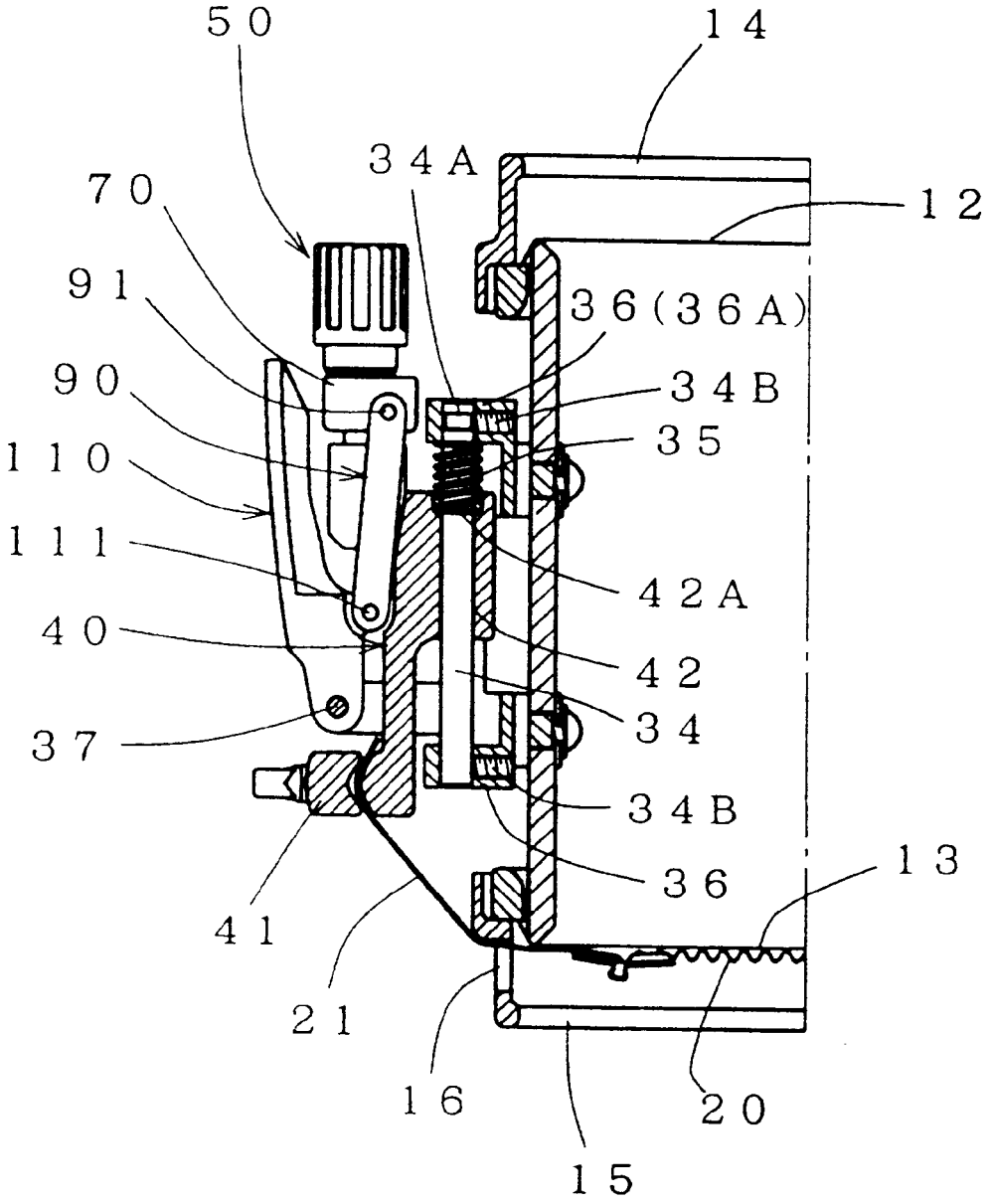
FIG. 8 is a cross section along like 8—8 in FIG. 6.

In addition, in FIGS. 6 and 8 the slide 40 is installed to be freely movable on the axle 34 in the up and down directions. A coil spring 35 on the vertical axle 34 of the base 31 is a downward intensifying member on the slide. The vertical axle 34 is inserted through an axial hole. The coil spring 35 is disposed between the upper portion 36A of the axle installation hole 36 of the base 31 and a step 42A that is formed at the top of the axial hole 42 in the slide 40, as shown in FIG. 8, so that the spring urges the slide downward.

Further, in FIG. 6, it is advisable to install a straight motion guide 43 that guides the slide 40 to move up and down between the base member 31 and the slide 40. The slide 40 is capable of stable straight motion up and down caused by the vertical axle 34 and the straight motion guide 43.

In FIGS. 4, 6 and 11, the straight motion guide 43 comprises a fixing screw 44 that is fixed to the base 31, as shown in FIG. 4. FIG. 10 shows an installation hole 44B for the fixing screw 44 in the base 31. FIG. 11 shows a washer 44A for the fixing screw 44.

A slide plate 45 in FIGS. 6 and 11 includes a guide groove 46 that slides along the fixing screw 44 which is installed on the slide 40 and this guides movement of the slide.

An installation screw 45A installs the slide plate 45 on the slide 40. At the slide 40 in FIG. 11, there is a buffer stopper 47 for the switch lever 110, described below, and an installation concave 48 is provided in the slide 40 for the buffer stopper 47.

FIGS. 7, 9 and 11 show that the slide height position adjustment members 50 and 60 respectively comprise a plurality of respective rods 51 and 61 that are fixed to the slide 40 and respective adjusting nuts 53 and 63 which are screwed onto the spiral threads 52 and 62 at the tops of the rods 51 and 61, such that the nuts are adjustable in the up and down directions.

The example shown provides a first position adjustment member 50 for low positions or low tension and a second position adjusting member 60 for high positions or high tension. Each rod 51 and 61 is fixed to the slide 40 by a respective spring pin 55A and 65A that is inserted into a respective installation hole 55 and 65 the slide 40 for each rod 51 and 61.

Adjustment knobs or caps 56 and 66 made of rubber enable rotation of the adjustment nuts 53 and 63. Chips 57 and 67 made of resin prevent possible loosening between the screw threads 52 and 62 on the rods 51 and 61 and the adjusting nuts 53 and 63. Screws 57A and 67A hold the resin chips 57 and 67. Rubber washers 58 and 68 below the nuts buffer the lifting members 70 and 80, described below.

Figure 12:
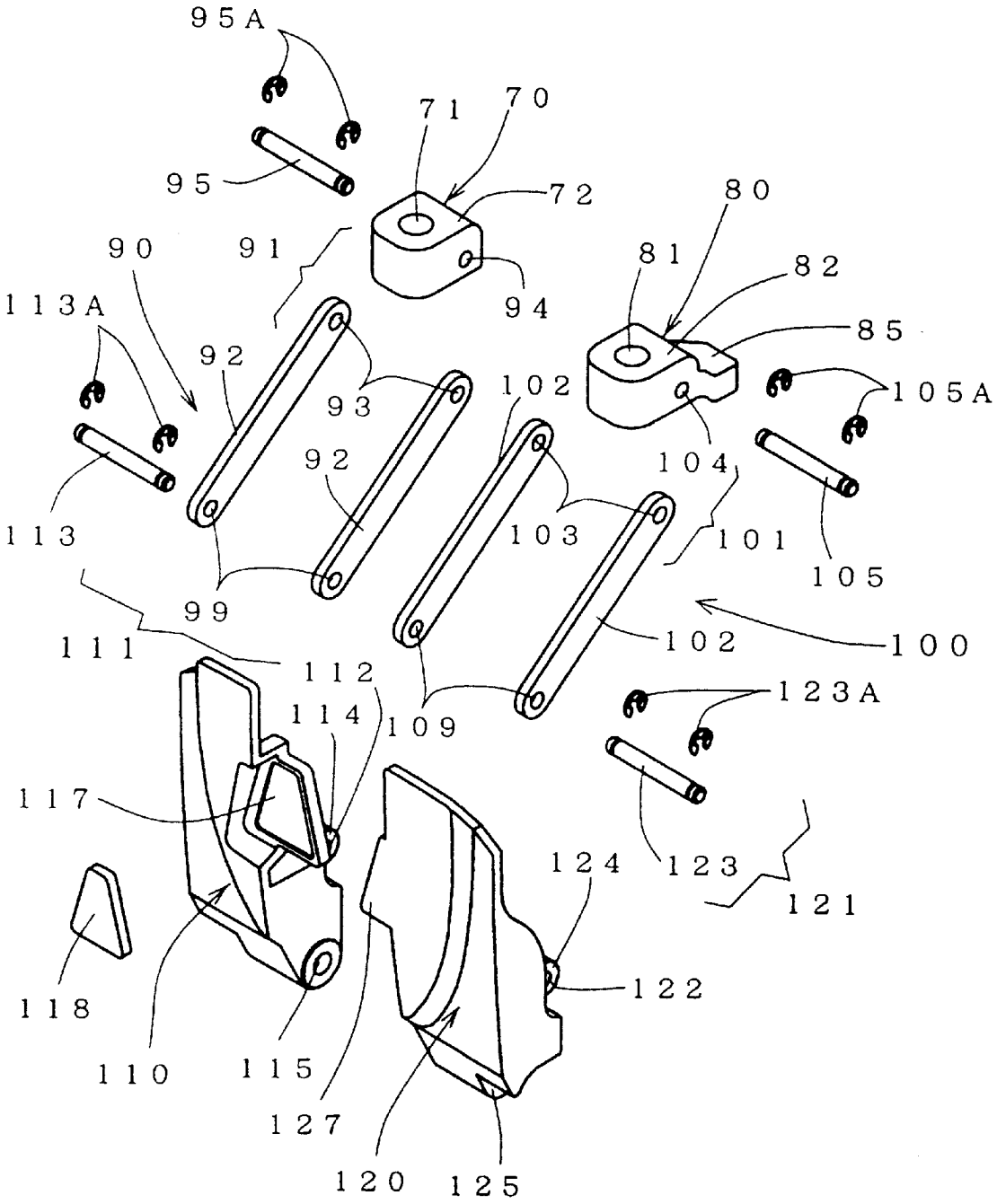
FIG. 12 is an oblique exploded view of the lifting member, the link member and the switch lever.

Referring to FIGS. 7, 9 and 12, lifting members 70 and 80 make it possible to raise each of the first and second position adjustment members 50 and 60 in engagement with the adjusting nuts 53 and 63. The lifting members 70 and 80 have insertion holes 71 and 81 through which the rods 51 and 61 extend. The upper surfaces 72 and 82 of the members 70 and 80 are able to respectively lift each of the position adjustment members 50 and 60 through the rubber washers 58 and 68 in engagement with the lower surfaces of the adjusting nuts 53 and 63.

The lifting member 80 in FIG. 12 includes a contact part 85 that contacts the stopper 39 via the buffer 39A which is provided at the extreme lower position of the base 31.

Referring to FIGS. 6, 8 and 12, the links 90 and 100 respectively have at one end thereof the axle coupling arrangements 91 and 101 for coupling the links with each of the lifting members 70 and 80. The links 90 and 100 are arranged respectively on both of the right and left sides of each of the respective lifting members 70 and 80. The links 90 and 100 comprise link bars 92 and 102 with linking holes 93 and 103 at their top ends. In FIG. 12, axle pins 95 and 105 are inserted into the horizontal axle holes 94 and 104 formed in the sides of the lifting members 70 and 80.

Stopper rings 95A and 105A hold the axle pins 95 and 105.

The other bottom end of each link 90 and 100 is respectively axially coupled with the switch lever 110 and 120.

In FIG. 12, the switch levers 110 and 120 are axle coupled at 111 and 121 with the bottom ends of the respective links 90 and 100. The levers 110 and 120 are each freely switchable by pivoting on the horizontal axle 37 of the base 31.

As is shown in FIGS. 7, 9 and 12, the coupling arrangements 111 and 121 of the switching levers 110 and 120 comprise the respective insertion holes 112 and 122 provided on the front sides of the switch levers 110 and 112. Side pins 113 and 123 are inserted through the linking holes 99 and 109 at the bottom ends of the link bars 92 and 102 where the axles are held by the stopper rings 113A and 123A. The protruding parts 114 and 124 include the insertion holes 112 and 122.

Insertion holes 115 and 125 are formed at the bottom of the respective switch levers 110 and 120. These receive the horizontal axle 37 of the stationary base 31. Each of the switch levers 110 and 120 may be rotated with the horizontal axle 37 as its center.

Rotation of each switch lever 110 and 120 moves the respective lifting member 70 and 80 and the position adjusting member 50 and 60 up and down through each of the link members 90 and 100, thereby making it possible for the slide 40 to be moved up and down.

As a consequence, each switch lever 110 and 120 lifts the corresponding position adjusting member 50 and 60, through the corresponding lifting member 70 and 80 by means of the corresponding link 90 and 100 at the time of switch on or at the time when each of the switch levers 110 and 120 has been raised toward the drum side, thereby making it possible for the slide 40 to be raised to its respective prescribed height position.

At switching or when each of the switch levers 110 and 120 is rotated down in the direction away from the drum trunk, the lifting of the position adjustment members 50 and 60 of the corresponding lifting members 70 and 80 via the corresponding link members 90 and 100 is removed, so that the slide 40 is lowered to its respective original height positions by the intensifying member 35.

Figure 5:
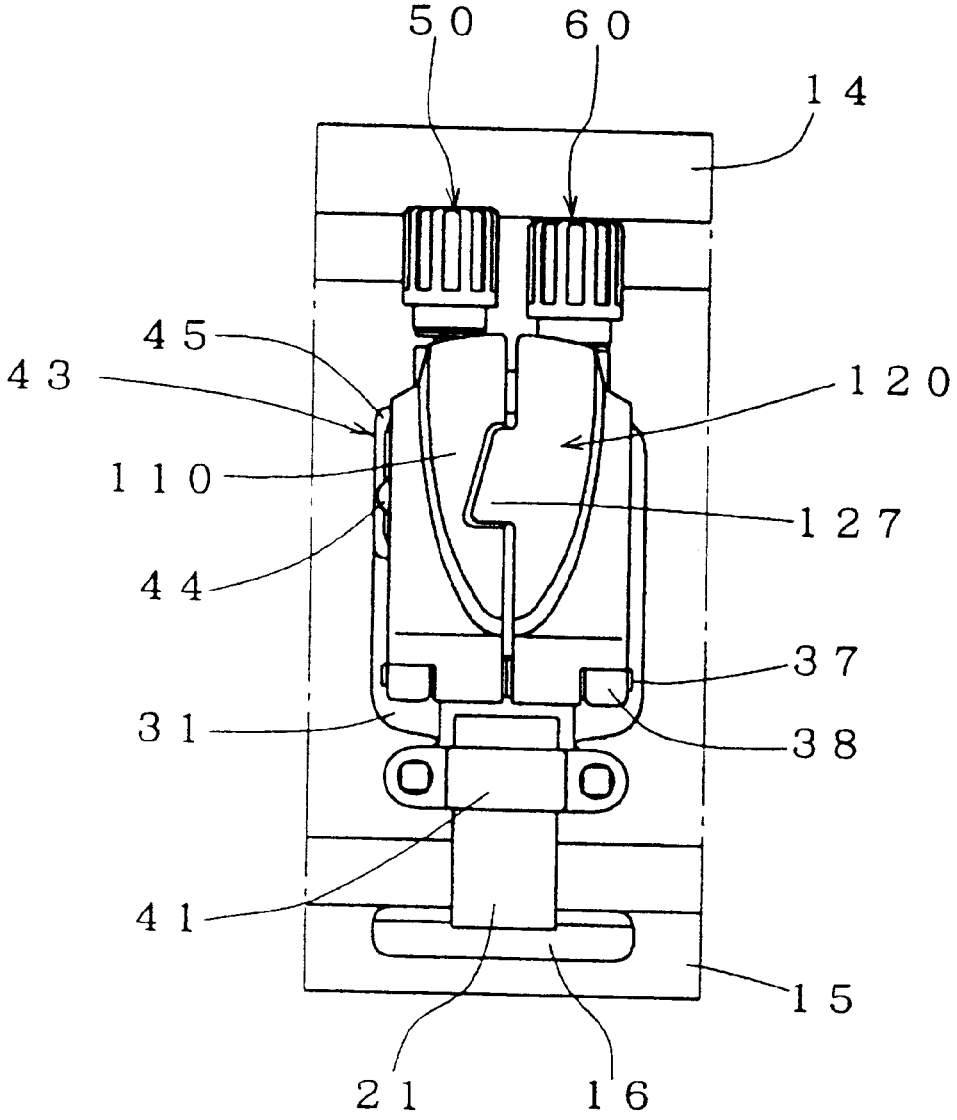
FIG. 5 is a front view of the snare strainer.

In FIGS. 5 and 12, the switch levers 110 and 120 have respective interacting engagement parts 117 and 127 that switch off the second switch lever 120 for high tension positions simultaneously with the switch off the first switch lever 110 for low tension positions. These include an inner engagement part 117 formed in the first switch lever 110 for low tension positions and an exterior engagement part 127 that engages the inner engagement part 117 formed in the second switch lever 120 for high tension positions. A buffer 118 is placed between the parts 117 and 127. During switch off, with the switch lever 110 for low tension positions being moved down and outwardly, the inner engagement part 117 engages the exterior engagement part 127 of the second switch lever 120 for high tension positions, causing the second switch lever 120 for high tension positions to also move down and outwardly at the same time, thereby enabling switching off the strainer with one touch action. In this case, further, if the second switch lever 120 for high tension positions is upraised inwardly, thereby switching it on, the switch lever 110 for low tension positions is also upraised inwardly at the same time, thereby switching on the strainer. This arrangement permits the first switch lever for low tension positions to be upraised inwardly while the second switch lever for high tension positions to remain lowered.

The switching action of the snare strainer is explained with reference to FIGS. 13 through 15. In these drawings, the switch levers 110 and 120 are cut off and omitted for facilitating the explanation. But when each switch lever is raised to its switched on state, it is shown by a broken line.

This example shows the switching of the two strainer tension positions, high and low, with the strainer on. The actual tension positions of the two strainers, high and low, are set at given positions by the performer adjusting them by rotating the adjustment nuts 53 and 63 of the position adjustment members 50 and 60 beforehand, as the performer wishes.

Figure 13:
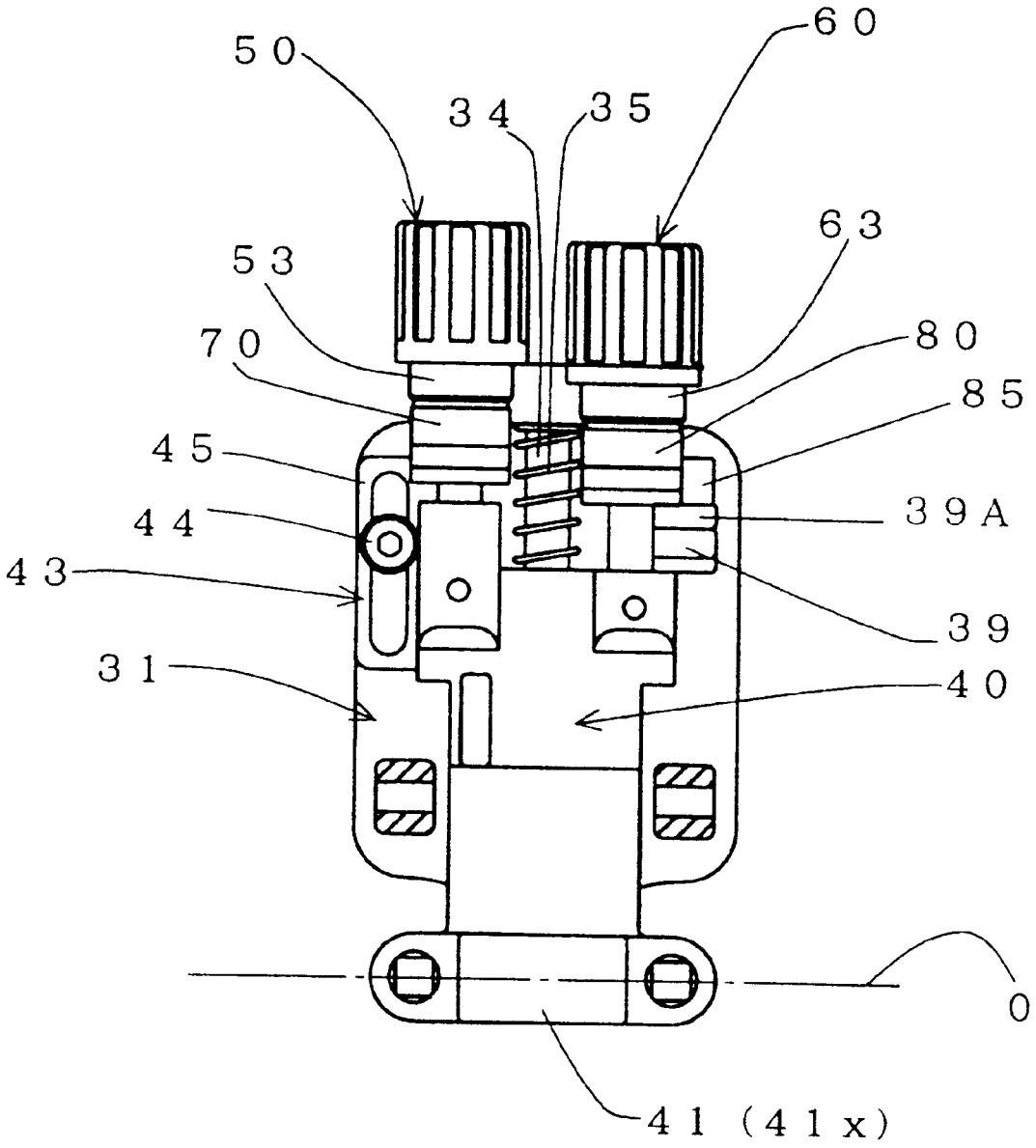
FIG. 13 is a cross section showing the off state of the strainer.
Figure 14:
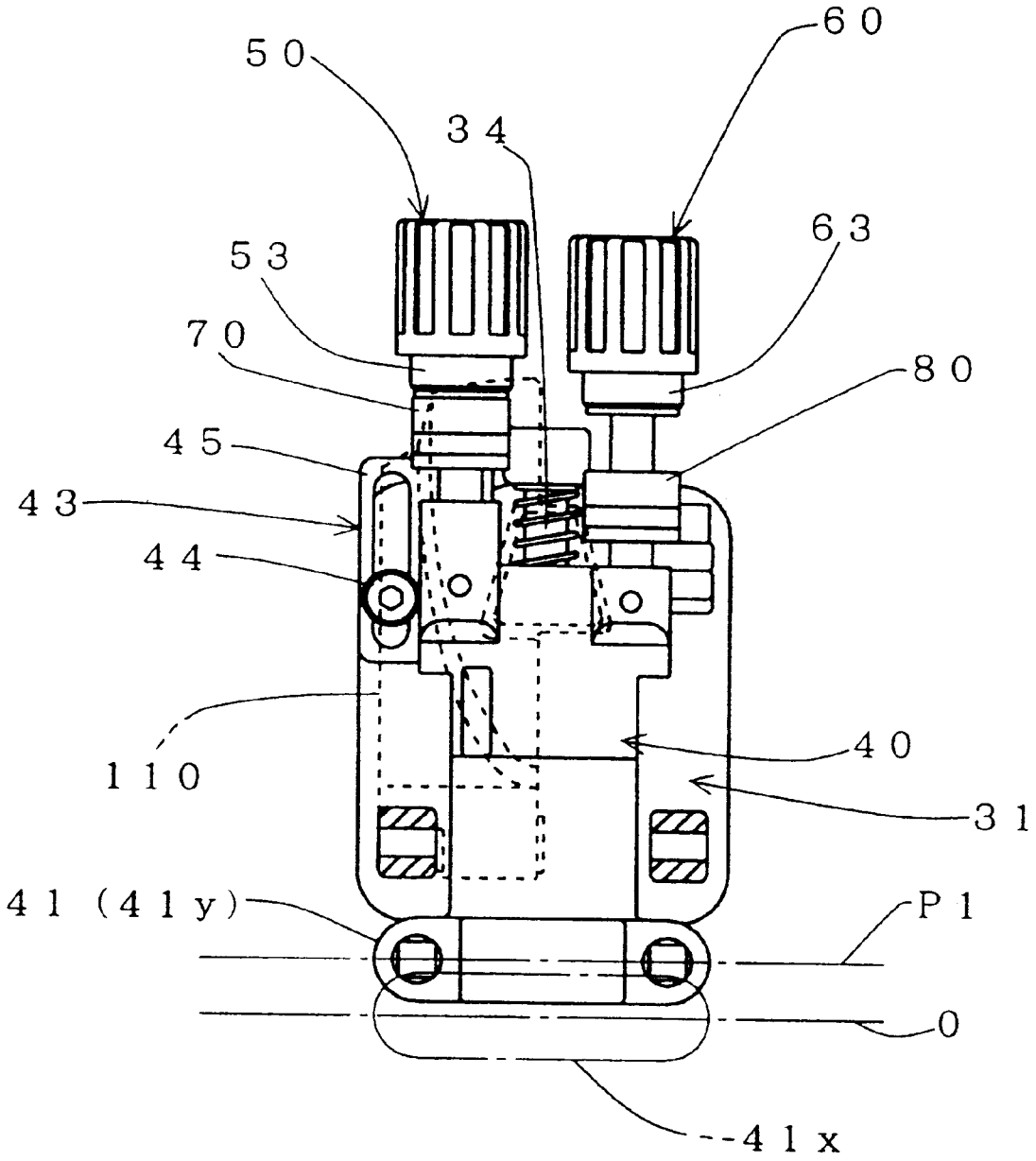
FIG. 14 is a cross section showing the on state of the switch lever for low tension positions.
Figure 15:
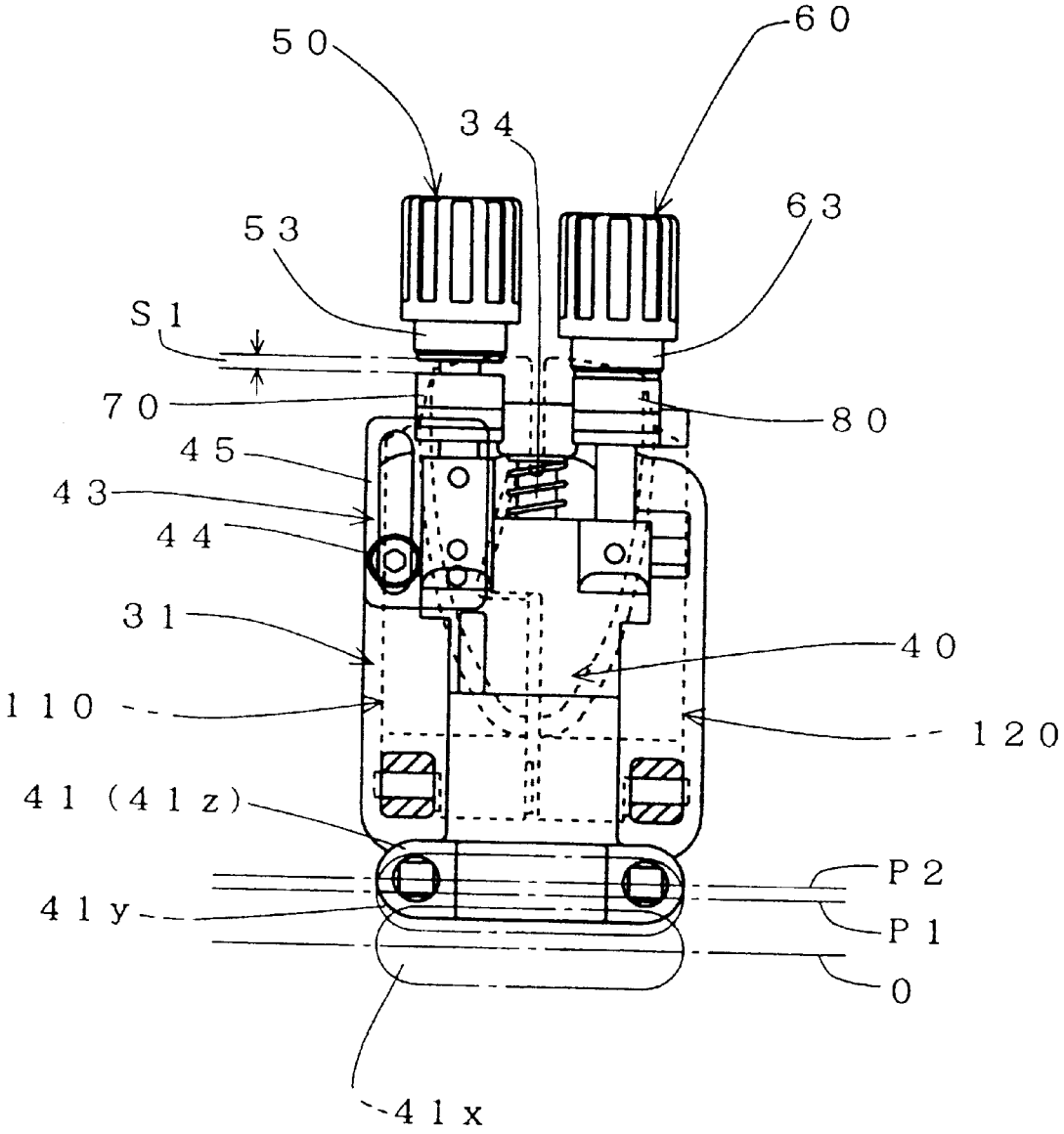
FIG. 15 is a cross section showing the on state of the switch lever for high tensions.

In FIGS. 13–15, the first adjustment member 50 for low tension positions is to the left. As described above, it is linked to the first lifting member 70, the first link 90 and the first switch lever 110. The second adjusting member 60 for high tension positions is to the right. It is linked to the second adjustment member 60 for high tension positions, the second lifting member 80, the second link 100 and the second switch lever 120.

FIG. 13 shows the strainer in the off state, in which both of the switch levers 110 and 120 are down. (In this example, the second lever 120 has been caused to be held down when the first switch lever is also down). The slide 40 is pressed down to the bottom by the spring 35 for giving downward strength, as the spring 35 is wound around the vertical axle 34 causing the slide 40 to be positioned at the position O in the drawing. At position O, the snare 20 is away from the bottom side drum head 13, where the snare 20 does not sound, as described above.

With the strainer in an off state, the stopper 39 and its buffer 39A regulate the extreme lowered position of the slide 40 on the base 31, as described above, thereby regulating the downward tile angle of the switch levers 110 and 120 as the stopper 39 touches the contact part 85 of the second lifting member 80. Moreover, possible generation of an allophone at the time of contact by the buffer 39A is prevented, while the standardized feeling at the time of a switch off is obtained.

FIG. 14 shows the state when the first switch lever 110 is set to its on position or is raised, which elevates the slide 40 to a preset low tension height position P1. In this state, the snare 20 installed on the slide 40 is pulled to touch the bottom-side drum head 13, causing snare performance.

As described above, as the first switch lever 110 is set to its on position, the corresponding first position adjustment member 50 is raised through the corresponding lifting member 70 by the corresponding link 90, which raises the slide 40 to the prescribed height position P1. In the drawing, the snare installation part 41 is at the height position O when the strainer is off, as shown in FIGS. 13 and 14. There is a stance of approximately eight millimeters in this example between the position O at the time when the strainer is off and the low tension height position P1 of FIG. 14.

When the first switch lever 110 is operated to on, the protruding part 114 of its axial coupling part 111 touches the slide 40. Since a buffer stopper 47 is provided at that part (see FIG. 9), possible generation of an allophone is prevented and, at the same time the standardized lever feeling at the time of switching is obtained.

FIG. 15 shows the state where the second switch lever 120 is operated to its on position or raised, wherein the slide 40 is rased to a prescribed high tension height position P2. Due to the engagement parts 117 and 118, this would carry the first switch lever 110 also up to the raised position, if it was not already up. The tension of the snare 20 installed on the slide 40 has been further raised from the low tension. As stated above, the corresponding second position adjustment member 60 is raised through the corresponding lifting member 80 by the corresponding link 100 when the second switch lever 120 is set on, raising the slide 40 to the prescribed height position P2.

In FIG. 15, the height distance S1 shows the raising distance caused by the second switch lever 120 above the low tension height position P1 due to the first switch lever 110. The snare installation part is at the position 41 at the low tension height position P1 shown in FIG. 14. In this example, there is a difference of approximately one to two millimeters between the low tension height position P1 and the high tension position P2.

During its operation, the outside engagement part 127 of the second switch lever 120 touches the inside engagement part 117 of the first switch lever 110. The buffer 118 provided at the part 117, however, prevents possible generation of an allophone while the standard lever feeling at the time of switching is obtained.

The foregoing shows that it is necessary to adjust the lower surface position of the adjustment nut 63 of the second adjustment member 60, which determines the high tension height position P2, to a position which is lower than the lower surface position of the adjustment nut 53 of the first adjustment member 50 which determines the low tension height position P1.

If the lower surface position of the adjustment nut 63 of the second adjustment member 60 happens to be higher than or at the same height as the lower surface position of the adjustment nut 53 of the first adjustment member 50, raising of the second adjustment member 60 is prevented, even when the second switch lever 120 is operated to on, subsequent to the on operation of the first switch lever 110. This is reasonable because both the first adjustment member 50 and the second adjustment member 60 are provided on a common slide 40.

The above described snare strainer for a snare drum enables setting a plurality of positions of the tension of the snare conforming to the wishes of a performer and without any step, making it possible to quickly switch the share position during a performance and to also alter the tone colors of the snare, as desired by a performer.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A device for adjusting and switching the tension of a snare on a drum head, comprising:

a drum having a drum trunk, a drum head at an end of the drum trunk, a snare extending across the drum head including a first end supported to the drum and including a second end supported to the adjustment device such that operation of the adjustment device adjusts and switches the tension of the snare across the drum head;

the adjustment device comprising:

a base attached to the drum trunk; the base including a vertical motion guide;

a slide supported for vertical motion on the vertical motion guide of the base;

an installation part on the slide including elements for holding the second end of the snare and selectively tensioning the snare as the slide moves with respect to the base;

a first and a second position adjustment member fixed to the slide and movable therewith, an adjustment element on each of the position adjustment members and being adjustable between a more elevated high tension position and a lowered lower tension position;

a respective first and second link for the first and second adjustment members, each link being pivotable at the respective adjustment member;

a respective first and second switch lever, each switch lever having a respective first pivot connection with a respective one of the first and second links, the switch levers having a respective second connection with the base such that each switch lever is movable between a lowered off and an upraised on position; movement of each switch lever to the respective on position operates the respective link to engage the respective position adjustment member such that elevation of at least one of the position adjustment members by the respective link elevates the slide to the respective height position set by the respective adjustment element on the respective position adjustment member and such that movement of each switch lever to the off position removes the raising of the respective position adjustment member toward the adjustment element and enables the slide to be lowered and reduces the tension on the snare.

2. The device of claim 1, wherein the second connection of each of switches is a pivot connection to the base so that the respective movement of each switch pivoting between the on and off positions.

3. The device of claim 2, wherein the pivot axis of each of the switches is transverse to the direction of sliding of the slide.

4. The device of claim 2, further comprising an intensification member between the base and the slide normally urging the slide to move in the direction for the reducing the tension of the snare.

5. The device of claim 2, wherein the first ones of the switching lever, the link and the adjustment element are for setting a low tension position for the slide and for the snare and the second ones of the switching lever, the link and the adjustment element are for setting a high tension position for the snare.

6. The device of claim 5, wherein each position adjustment member attached to the slide comprises a shaft on which the respective adjustment element is disposed;

a respective lifting member on and movable along each of the shafts, each of the links being connected with the respective lifting member, whereby the link engages the adjustment element through the respective lifting member.

7. The device of claim 6, wherein adjusted positions of the adjustment elements, the links and the switches are selected so that the slide has different respective positions with respect to the base for no tension, low tension, and high tension of the snare.

8. The device of claim 3, further comprising cooperating engagement parts positioned on the first and second switch levers so that the first switch lever for low tension can be operated on and off without operating the second switch lever for high tension to the on position while the operation of the second switch lever to the on position also moves the first switch lever to the on position.

9. The device of claim 3, wherein the vertical motion guide comprises an axle on the base extending vertically along the drum trunk, and the slide being movable along the axle.

10. The device of claim 1, wherein each position adjustment member attached to the slide comprises a shaft on which the respective adjustment element is disposed;

a respective lifting member on and movable along each of the shafts, each of the links being connected with the respective lifting member, whereby the link engages the adjustment element through the respective lifting member.

11. The device of claim 10, wherein each of the shafts has a screw threaded region, and the respective adjustment element comprises an adjustment nut on the screw threaded region and adjustable therealong for controlling the extent of movement of the lifting member, the movement of the link and the permissible movement of the slide.

* * * * *